US005638761A

United States Patent [19]

Berkowitz et al.

[11] Patent Number: 5,638,761

[45] Date of Patent: Jun. 17, 1997

[54] FOLDABLE TABLE LEG

[75] Inventors: Alan J. Berkowitz; Elliott W. Baum, both of St. Louis County; Lucian N. Chirea, St. Louis, all of Mo.

[73] Assignee: Berco Industries, St. Louis, Mo.

[21] Appl. No.: 100,273

[22] Filed: Aug. 2, 1993

[51] Int. Cl.[6] ..... A47B 3/00

[52] U.S. Cl. ..... 108/132; 108/133

[58] Field of Search ..... 108/133, 132, 108/131, 130; 248/188.1, 188.6, 166, 434, 440

[56] References Cited

U.S. PATENT DOCUMENTS

| | | | |
|---|---|---|---|
| 1,778,124 | 10/1930 | Sauer | 108/132 |
| 2,318,945 | 5/1943 | Johannsen | 108/133 |
| 2,448,360 | 8/1948 | De Saussure | 108/132 |
| 2,474,450 | 6/1949 | Woodruff | 108/132 |
| 2,572,474 | 10/1951 | Hamilton | 108/132 |
| 2,684,883 | 7/1954 | Wigell | 108/133 X |
| 3,606,846 | 9/1971 | Andrews et al. | 108/132 |
| 5,109,778 | 5/1992 | Berkowitz et al. . | |

*Primary Examiner*—Jose V. Chen
*Attorney, Agent, or Firm*—Paul M. Denk

[57] ABSTRACT

A foldable table leg for use in combination with a tabletop, the combination having a table surface including a top surface and a bottom surface, at least one foldable leg, the foldable leg includes a leg connecting template fixed to the table surface bottom for securing the foldable leg to the table, a column base support attached to the leg connecting template for pivotally receiving the foldable leg reciprocally between a folded position and a supporting position, a track for positioning the foldable leg between folded position and supporting position, an arm support pivotally secured at one end to the table leg and slidably engaged at another end to the track, the arm support for guiding the leg between folded position and supporting position, structure for locking the table leg in supporting position, a release mechanism for releasing the table leg from a supporting position into a folded position wherein the foldable table leg is light-weight.

5 Claims, 2 Drawing Sheets

FOLDABLE TABLE LEG

BACKGROUND OF THE INVENTION

The present invention relates to tables, and in particular, to a foldable table leg for use in combination with a tabletop. The foldable table leg permits a table to collapse into a position suitable for storage. The invention provides a folding table leg that is durable yet light-weight. While the invention is described in particular detail with respect to its use in combination with a tabletop, those skilled in the art will recognize the wider applicability of the invention disclosed hereinafter.

Folding tables are well known in the art, including the folding table of our U.S. Pat. No. 5,109,777. Folding tables are commonly used in environments where furniture is actively arranged and frequently placed in storage. For example, in corporate settings, different events require varied organization of tables. Certain events demand arranging several tables in a short period of time. Using heavy tables in settings involving substantial rearrangement is awkward and cumbersome. Nevertheless, heavy tables provide durability and therefore are frequently selected over light-weight tables.

Most of the sturdy folding tables in the prior art use heavy materials to form the individual table parts. Unfortunately, using these materials results in tables that are weighty, difficult to move, complex to set up and sometimes unattractive in appearance.

SUMMARY OF THE INVENTION

It is, therefore, an object of the present invention to provide a foldable table leg for use in combination with a tabletop that is light-weight.

Another object of the present invention is to provide a foldable table leg for use in combination with a tabletop that is easy to use.

Yet another object of the present invention is to provide a foldable table leg for use in combination with a tabletop that is attractive and inexpensive.

Still another object of the present invention is to provide a foldable table leg for use in combination with a table top that is durable.

Other objects and features will become apparent to those skilled in the art in light of the following description and accompanying drawings.

In accordance with this invention, generally stated, a foldable table leg for use in combination with a tabletop is provided, the combination having a table surface including a top surface and a bottom surface at least one foldable table leg, the foldable table leg includes a leg connecting template mounted to the table surface bottom, the leg connecting template for attaching the foldable table leg to the table, a column base support means secured to the leg connecting template for pivotally receiving the foldable leg reciprocally between a folded position and a supporting position, a track secured intermediate to said template for positioning said foldable leg between said folded position and said supporting position, an arm support pivotally secured at ode end to the table leg and slidably engaged at another end to the track, the arm support guides the leg from a folded position to a supporting position, a means for locking the table leg in the supporting position attached to the track, a release mechanism for releasing the table leg from the supporting position into the folded position.

The table leg provides a durable yet light-weight component for use with a table surface. The table leg furnishes ruggedness and stability without compromising appearance. The folding table leg in combination with the tabletop provides a table that is simple to set up and not burdensome to move.

BRIEF DESCRIPTION OF THE DRAWINGS

Referring to the drawings which disclose one advantageous embodiment of the present invention and several modifications thereof.

DESCRIPTION OF A PREFERRED EMBODIMENT

Figure 1:
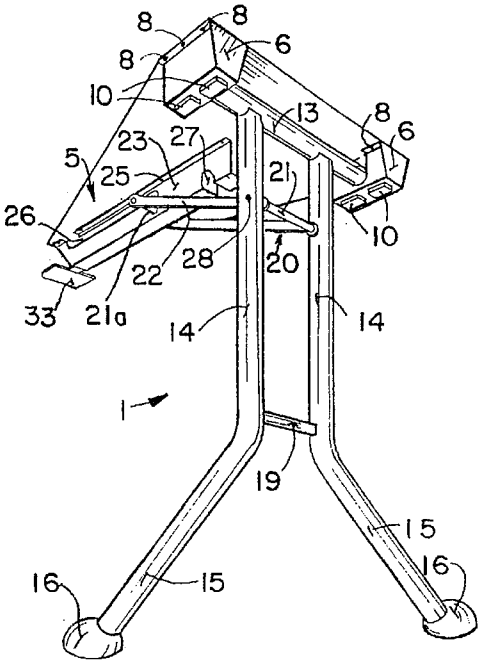
FIG. 1 is an isometric view of the inventive foldable table leg.

Referring now to the drawings for one illustrative embodiment of foldable table leg of the present invention, reference numeral 1 indicates one illustrative embodiment of the foldable table leg.

Figure 2:
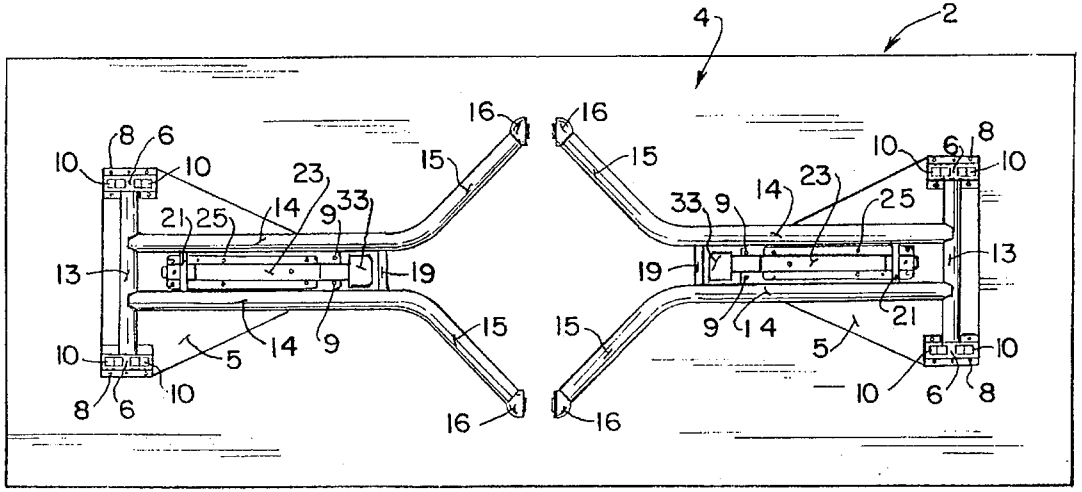
FIG. 2 is a bottom plan view of the foldable table leg in combination with a table top in folded position.
Figure 3:
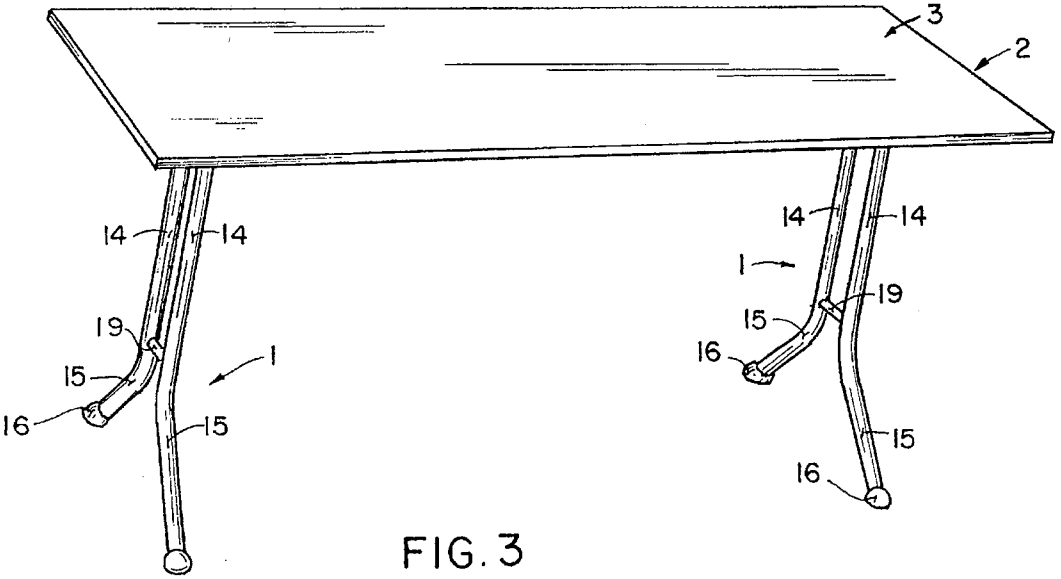
FIG. 3 is an isometric view of a table top in combination with foldable table leg in supporting position.
Figure 4:
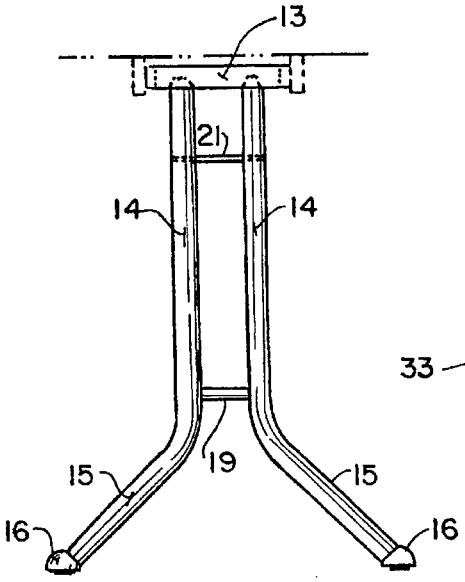
FIG. 4 is a front elevational view of the foldable table leg.
Figure 5:
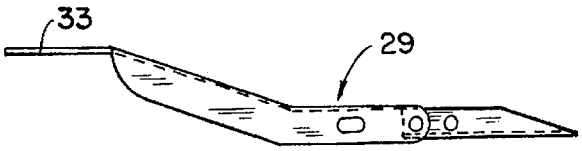
FIG. 5 is a side elevational view of the release mechanism of the foldable table leg.
Figure 6:
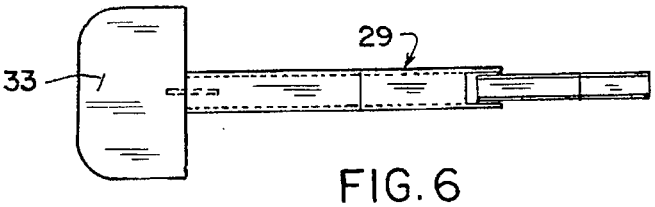
FIG. 6 is a top plan view of FIG. 5.
Figure 7:
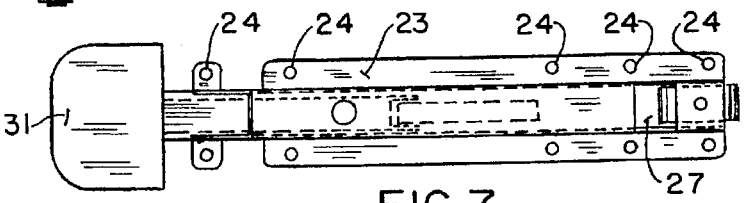
FIG. 7 is a top plan view of the release mechanism with the locking means of the claimed invention.

In particular, the foldable table leg 1 may be used in combination with a table surface 2, as shown in FIGS. 2 and 3. Table surface 2 includes a top surface 3 and a bottom surface 4. A leg connecting template or bracket 5 affixes foldable table leg 1 to its bottom surface 4. Template 5 fastens to bottom surface 4 for positioning table leg 1 on table surface 2. In one embodiment, shown in FIG. 2, template 5 is triangular in shape and is fixed to bottom surface 4 near outer edges of surface 2.

A column base support means 6 shown in FIGS. 1, 10–12, is attached at each of the outer ends of table surface 2. Column base support means 6 fixes foldable leg to template 5 and provides stability for foldable leg of the table. Apertures 7 are formed in alignment through template 5 and column base support means 6 to secure both to table surface 2. Apertures 7 are sized to engage bolts 8 which jointly secure column base support means 6 and template 5 to table surface 2. At the end opposite column base support means 6, template 5 attaches to table surface 2 shown at 9.

Figure 11:
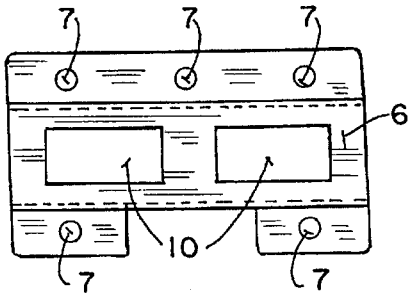
FIG. 11 is a top plan view of FIG. 10.
Figure 12:
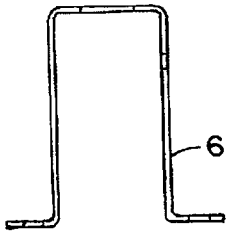
FIG. 12 is an end elevational view of FIG. 10.

In the embodiment shown in FIGS. 1–2 and 11, column base support means 6 includes a pair of bumpers 10. Bumpers 10 secure to the upper surface of column base support means 6. The bumpers 10 separate individual tables preventing scratching and other table damage when stacked for storage.

Figure 9:
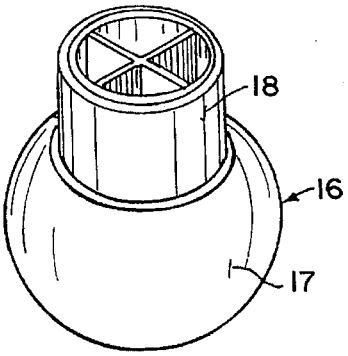
FIG. 9 is an isometric view of the foot of the inventive foldable table leg.

A side wall 11 of column base support means 6 has an opening 12 sized to enclose a support or cross bar 13. Support bar 13 provides reinforcement strength for foldable table leg 1. Support bar 13 is pivotally received at each end in openings 12 of column base support means. In the embodiment shown in FIGS. 1–4, at least one leg, such as a pair of legs 14 extend perpendicularly from support bar 13. Legs 14 taper outwardly at the floor contacting ends 15 providing tabletop 2 with stability. Each of legs 14 includes a foot 16, as shown in FIG. 9. Foot 16 provides a level base for foldable leg 1 at floor contacting ends 15. Foot 16 has a spherical base 17 with a cylindrical member 18 protruding from the upper portion of spherical base 17. Cylindrical member 18 has a diameter smaller than spherical base 17 and is sized to engage floor contacting ends 15 of legs 14.

A flat connector 19 joins legs 14 proximate their floor contacting ends 15 providing stability for foldable table leg 1. An arm support 20 is attached adjacent to support bar 13 for guiding foldable leg into position, either when arranged in storage or when erected for usage. Arm support 20 reciprocally directs legs 14 between a supporting position and a folded position. In supporting position, foldable legs 14 extend perpendicularly from table surface 2. In folded position, foldable legs 14 lie flat against bottom surface. Arm support 20 shown in FIG. 13 includes an arm support cross bar portion 21 and a vertical portion 22.

Figure 8:
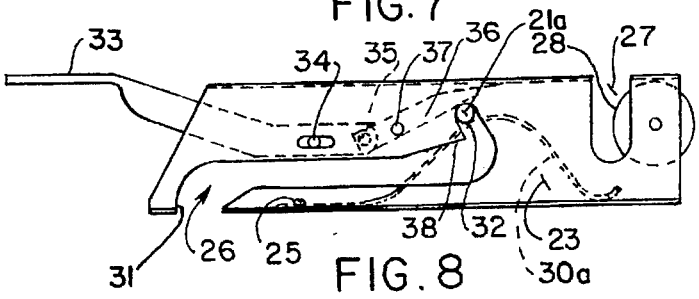
FIG. 8 is a side elevational view of FIG. 7.
Figure 10:
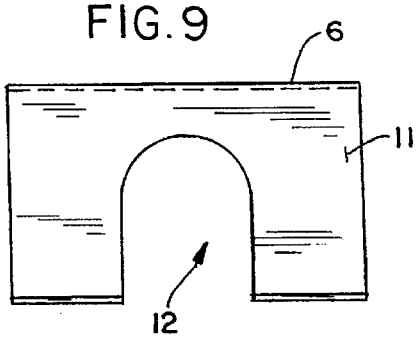
FIG. 10 is a front elevational view of the column base support of the inventive foldable table leg.

A track 23 attaches to template or bracket 5 for channeling foldable leg 1 between supporting position and folded position. In one embodiment, track 23 includes apertures 24 for securing track 23 to table surface 2. In the embodiment shown, bolts 25 affix track 23 to template 5. As shown in FIG. 8, track 23 includes slot 26 sized to engage arm support cross bar 21*a* throughout the range of positions between supporting position and folded position. Track 23 also has a resting groove 27 for housing arm support cross bar 21 when table leg 1 is in folded position. Arm support 20 is pivotally secured at one end to table leg 1, shown in FIG. 1 at 28. The other end of arm support 20, as at 21*a*, is slidably engaged to track 23 within its formed slot 26. The arm support 20, through its cross member 21*a*, reciprocally guides the table leg 1 from its folded position, wherein the member 21*a* will come to rest at the position 31, proximate the entrance into the slot 26, of the track 23. On the other hand, when the table is erected, as when arranged for usage, the member 21*a* will have slid to the opposite end of the track 26, within its angled supporting slot 32, as when the table legs 1 are erected, to support the table into its usable position. Thus, the member 21*a* shifts between these two extremes, 31 and 32, within the slot 26, when arranged between its functional condition, to that of storage.

As can also be noted, there is a release mechanism 29, incorporating an extended handle 33, with this handle being pivotally connected, as at 34, within the track 23. The handle also pivotally connects, as at 35, with a release lever 36, as noted. The release lever 36 is pivotally connected within the track 23, by means of the pin 37. The release mechanism 29 cooperates with a spring 30, to provide the means for holding the table legs 1 in their erected position, but can be released by means of the release mechanism 29, when it is desired to fold the table into its storage condition. Thus, when the table is elected, and the legs extend downwardly at a perpendicularity to the table top surface, the cross member 21*a* of the arm support 20 is held into position by means of the spring 30. This can be seen in the hidden line configuration for the spring, as noted at 30*a*. In that position, as noted, the spring will bias against the cross member 21*a*, and fix the legs into their erected condition. But, when the release mechanism 29 is actuated, by raising upwardly upon the handle 33, it pivots downwardly at the pivot point 35, thereby pivoting the lever 36, and since the opposite end of the lever 36 engages against the proximate surface of the track 23, as noted, it forces the leg cross member 21*a* downwardly, until such time as it clears the surface 38, thereby allowing the leg to be pivoted forwardly, towards the end 31 of the slot 26. Thus, at that time, the member 21*a* will have cleared its locating within the angled slot 32, allowing the leg then to be pivoted into alignment with the undersurface of the table top 3, and into its folded position.

The resilient locking means 28, provided at the opposite end of the track 23, provides a means for holding the cross bar 21, within its slot 27, when the legs of the table are folded into their nonusable position the resilient locking means 28 may comprise a rubber roller, as shown, or other catch, or the like.

This release mechanism, when actuated, allows the legs 14 of the table to be folded into the folded position wherein the legs lie flat against the underside of the table surface 4, as when not in usage.

Variations or modifications to the subject matter of this invention may occur to those skilled in the art upon reviewing the disclosure as made herein. Such variations, if within the spirit of this invention, are intended to be encompassed within the scope of any claims to patent protection issuing upon this development. The description of the preferred embodiment set forth herein is done so primarily for illustrative purposes only.

Having thus described the invention, what is claimed and desired to be secured by Letters Patent is:

1. A foldable table leg for use in combination with a table top, the combination having a table surface including a top surface and a bottom surface, at least one foldable leg, said foldable leg includes a leg connecting template fixed to the table surface bottom, said leg connecting template for pivotally securing said foldable table leg to said table, a column base support means attached to said leg connecting template, said column base support means for pivotally receiving said foldable leg recriprocally between a folded position and a supporting position, a track provided intermediate to said leg connecting template, said track for positioning said foldable leg between said folded position and said supporting position, an arm support pivotally secured at one end to said table leg and slidably engaged at another end to said track, said arm support for guiding said leg from said folded position to said supporting position, means for locking said table leg in said supporting position, said locking means attaching to said track, a pivotally mounted release mechanism for releasing said table leg from said supporting position and into said folded position, said folded position for said table leg comprising said folding table leg lying flat against said table bottom surface, said supporting position comprising said folding table leg extending perpendicularly from said table bottom surface, said track having a designed slot provided therein, said arm support including a cross member, said cross member arranged within said designed slot of said track, whereby said foldable leg being pivotal from a supporting position to a folded position, and said cross member shifts within said track slot to provide for retention of said leg at either of its adjusted positions, a spring means operatively associated within said track, said spring means cooperating with said cross member of the arm support to fix said table leg at its erected position with the cross member of the arm support being located at one end of said track slot, and said spring capable of being biased into a condition for releasing said cross member and allowing said table leg to be pivoted into its folded position, said release mechanism cooperating with said cross member and spring means to provide for releasing table leg from its supporting position for shifting into its said folded position, said spring biasing said cross member into direct contact with said release mechanism when said table leg is at its erected position with the cross member of the arm support being located at one end of the said track slot, and with said spring means biasing said cross member contiguously against the release mechanism when the table is in its erected position.

2. The foldable table leg of claim 1 wherein said release mechanism incorporating a pivotally connected arm and lever, whereby upon actuation of said release mechanism, through pivot of its arm, thereby disposing the lever for biasing contiguously against the cross member to urge against the spring to provide for release of the cross member for shifting along the track slot and allowing the table leg for pivot into its folded position.

3. The foldable table leg of claim 1 wherein said table leg being formed of light-weight material, and said light-weight material being steel tubing.

4. The foldable table leg of claim 2 wherein said column base support means includes at least one bumper for protecting said table leg in its folded position during storage.

5. The foldable table leg of claim 2 wherein said leg includes a foot.

* * * * *